US005249957A

United States Patent [19]

Hirata

[11] Patent Number: 5,249,957

[45] Date of Patent: Oct. 5, 1993

[54] EMULSION PRODUCING APPARATUS AND ITS COMBUSTION SYSTEM

[76] Inventor: Kiichi Hirata, 44-2, Tomioka-nishi 7-chome, Kanazawa-ku, Yokohama-shi, Kanagawa, Japan

[21] Appl. No.: 828,804

[22] PCT Filed: Jun. 10, 1991

[86] PCT No.: JP91/00776
§ 371 Date: Feb. 3, 1992
§ 102(e) Date: Feb. 3, 1992

[87] PCT Pub. No.: W091/19944
PCT Pub. Date: Dec. 26, 1991

[30] Foreign Application Priority Data

Jun. 14, 1990 [JP] Japan ..... 2-154136

[51] Int. Cl.[5] ..... F23C 11/00

[52] U.S. Cl. ..... 431/354; 431/4:353; 366/249; 366/257; 366/273

[58] Field of Search ..... 431/4, 6, 12, 91, 332, 431/333, 356, 352, 354; 366/249, 257, 273

[56] References Cited

U.S. PATENT DOCUMENTS

| | | | |
|---|---|---|---|
| 3,648,714 | 3/1972 | Laveau | 137/889 |
| 4,416,610 | 11/1983 | Gallagher, Jr. | 431/4 |
| 4,443,180 | 4/1984 | LeFrois | 431/4 |
| 4,519,769 | 5/1985 | Tanaka | 431/4 |
| 4,801,304 | 1/1989 | Polanco et al. | 431/4 |
| 5,000,757 | 3/1991 | Puttock et al. | 431/4 X |

FOREIGN PATENT DOCUMENTS

| | | |
|---|---|---|
| 58-52910 | 3/1983 | Japan . |
| 456544 | 7/1968 | Switzerland . |

OTHER PUBLICATIONS

Patent Abstracts of Japan, vol. 006, No. 202 (C-129) 13 Oct. 1982 & JP-A-57 111388 (Mitsushisa Matsuoka) 10 Jul. 1982.

Patent Abstracts of Japan, vol. 011, No. 307 (C-450) 7 Oct. 1987 & JP-A-62 095393 (Hotukou) 1 May 1987.

Soviet Patents Abstracts, Section Ch. Week 8717,6 May 1987, Derwent Publications Ltd., London), GB; Class JO2, AN 87-121032/17 SU-A-1255 190 (Ivano-Frank Oil Res) 7 Sep. 1986.

*Primary Examiner*—Larry Jones

*Attorney, Agent, or Firm*—Armstrong, Westerman, McLeLand, Hattori & Naughton

[57] ABSTRACT

An apparatus for producing an emulsion by agitatedly mixing liquid fuel and water. Low pollutant level emissions and an efficient combustion system are realized by burning this emulsion. An agitator chamber supplies liquid fuel and water from a liquid fuel tank and a water tank and agitating blades are arranged inside agitator chamber to agitatedly mix liquid fuel and water. Movable permanent magnets are fixed on agitator disks and an agitating blade driving motor rotates agitating blades to produce an ionized emulsion. A pump pressurizes the emulsion and a burner sprays it for burning.

7 Claims, 5 Drawing Sheets

EMULSION PRODUCING APPARATUS AND ITS COMBUSTION SYSTEM

BACKGROUND OF THE INVENTION

Field of the Invention

This invention relates to an emulsion producing apparatus for producing an emulsion, a mixture of liquid fuel and water, and its combustion system. To be more precise, it is an object for producing an emulsion by agitatedly mixing liquid fuel and water and burning it. It also pertains to the realization of a low pollution, highly efficient emulsion producing apparatus and its combustion system for burning the emulsion.

Description of the Related Art

Although burning apparatuses are either used alone or in combination with a combustion chamber, the most important function is the need for perfect combustion of the supplied fuel. Namely, the combustion efficiency should be close to 100%. Furthermore, the size and shape of a flame must appropriately adapt to each condition and the combustion loading factor should be of an adequate value.

According to the circumstances, equal temperature distribution or a desired distribution will be required. Also, in recent years, public demand to minimize as much as possible the creation of air pollution consisting of nitrogen oxides, smut, carbon monoxide, etc., as well as noise pollution, has been strong.

For example, B and C heavy oils are being used for boilers and furnaces. However, recently, sulfur dioxide (SOx) and nitrogen dioxide (NOx) in emissions have become a problem. Therefore, crude oil, naphtha, kerosene, etc. are also being used. The SOx in emissions is in the sulfur content of fuel. Accordingly, in keeping with the tightening regulation against SOx in emissions, fuel with a low sulfur content is being used.

In order to deal with this, the use of low sulfur content crude oil, the installation of desulfurizing equipment, the installation of antismoke purification equipment, the change of fuel, etc. are being implemented. However, the low sulfurization of crude oil has almost reached its limit. Furthermore, although NOx emission is mostly created by combustion, a part of the nitrogen in fuel converts to NOx. It is said that this conversion is between 10 and 40%.

Burning apparatuses are generally structured along fuel and air supply systems. The essential part of the fuel supply system is the fuel spraying apparatus which sprays fuel with an appropriate amount of movement. In the case of liquid fuel, it is reduced to fine particles and dispersed. The essential part of the air supply system is the air register to efficiently mix air for burning the sprayed fuel. Together with stabilizing the flame in the air stream, in order to control the burning characteristic, it possesses the function to regulate and adjust the flow of air. Namely, it is necessary to actively send an optimum amount of air.

The combustion apparatus for burning liquid fuel is generally referred to as an oil burner, and is separated into the spray and vaporization types. The spray-type is a burning method in which, in order to make the surface area per unit capacity of fuel i.e., ratio of surface area, as large as possible, the fuel is broken down into numerous diametrically small fine particles. Although the combustion load factor cannot be raised too high, even heavy oil is burned. To the contrary, the vaporization-type vaporizes fuel by using the high surface temperature of physical soilds.

Incidentally, global environmental concern has mounted in recent years and demand for reducing nitrogen dioxide (NOx) is rapidly becoming stronger. Although many methods for reducing nitrogen dioxide (NOx) have been proposed, among them for example, Japanese Patent Laid Open (KOKAI) No. 61-91407, opened to the public in 1986, which consists of an oxygen-added emulsion fuel supplying method for water mixed with a high density oxygen or pure oxygen and then, this mixture is further mixed with a part or all hydrocarbon fuel. This system requires the supply of pure oxygen or air with a high oxygen density content.

Moreover, when air is used, the effect of nitrogen in the air increases the nitrogen oxides. This system will also require the assembly of a complicated circuit. Many methods for mixing water or steam with fuel have been proposed (Japanese Patent Laid Open (KOKAI) No.52-25807, opened to the public in 1977; Japanese Patent Laid Open(KOKAI) No.63-14801, opened to the public in 1988, and numerous othres). Furthermore, many proposals have been made for burning liquid or gaseous fuel after its having passed through a magnetic field in advance and mixing it with air to burn. (for example, Japanese patent Laid Open(KOKAI) No.63-247511, opened to the public in 1988; Japanese Patent Laid Open(KOKAI) No.60-218519, opened to the public in 1985, etc.)

However, in either case, by means of actively supplying air when burning, air must be supplied and the creation of nitrogen oxides from excess air is unavoidable.

SUMMARY OF THE INVENTION

It is an object of the present invention to provide an emulsion producing apparatus and its combustion system for reducing nitrogen oxides.

It is another object of the present invention to provide an emulsion producing apparatus for emulsifying liquid fuel and water and its combustion system to improve burning efficiency.

It is still another object of the present invention to provide an emulsion producing apparatus and its combustion system to ionize liquid fuel and water for burning to improve burning efficiency.

When burning emulsion produced by the emulsion producing apparatus of this invention, a combustion gas with exceedingly little NOx can be realized because there is no necessity for actively supplying air. Furthermore, if the emulsion is burned with the combustion system of the present invention, heat transfer is good because there is a lot of vapor in the combustion gas.

The essentials of this invention are contained in the following summarized points:

- a liquid fuel tank for storing liquid fuel;
- a water tank for storing water;
- an agitating chamber to which said liquid fuel and said water from said liquid fuel tank and said water tank are supplied;
- an agitating blade arranged inside said agitating chamber to agitatedly mix said liquid fuel and water;
- a plurality of movable magnets arranged in said agitating blade; and
- an agitating blade driving motor for driving said agitating blade.

A second emulsion producing apparatus comprising:

a liquid fuel tank for storing liquid fuel;

a water tank for storing water;

a fuel agitating section to which said liquid fuel and said water from said liquid fuel tank and said water tank are supplied;

a first agitating blade arranged inside said agitating section for agitatedly mixing said liquid fuel and said water;

a plurality of first movable magnets arranged in said first agitating blade;

a first agitating blade driving motor for driving said first agitating blade;

a second agitating blade arranged inside said fuel agitating section to counter said first agitating blade;

a plurality of second movable magnets arranged in said second agitating blade; and a second agitating blade driving motor for driving said agitating blade.

The emulsion produced by either the first or second emulsion producing appartus is burned by the following combustion system:

fuel pumps for pressurizing emulsion produced from said liquid fuel and said water drawn out from said agitator chamber;

a burner for spraying said emulsion from said fuel pumps into fine particles and spray.

Furthermore, this emulsion is better burned by adjusting the combustion chamber in the following way:

a combustion chamber which is formed with space provided inside and numerous slits to burn said emulsion from said burner.

Numerous slits are formed in this combustion chamber; moreover, space is provided inside (the combustion chamber) to burn the fuel from said burner.

BRIEF DESCRIPTION OF DRAWINGS

FIG. 2(*b*) is a sectional view taken along line b—b of FIG. 2(*a*);

DETAILED DESCRIPTION OF THE PREFERRED EMBODIMENTS

Figure 1:
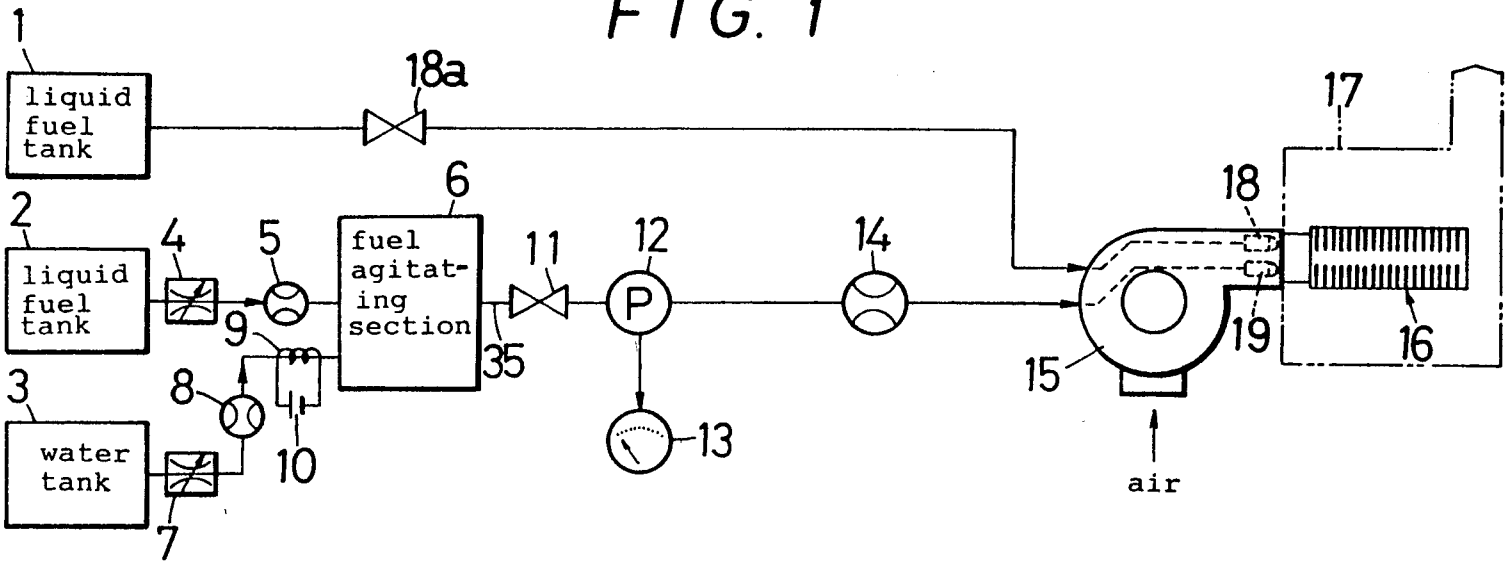
FIG. 1 is a functional block drawing showing the outline of the combustion system of the present invention.

A preferred embodiment of this invention will be described in accordance with the Figs. as follows:

FIG. 1 is a functional drawing showing the outline of the combustion system. First liquid fuel tank 1 is a tank for storing liquid fuel to preheat (to be described later) combustion chamber 16. This liquid fuel is sent to fuel spray valve 18 through cock 18*a* to the pump (not shown in drawing) inside burner 15. The pump pressurizes the liquid fuel stored in second liquid fuel tank 2. Water tank 3 is for storing water to be agitatingly mixed with the liquid fuel from the second liquid fuel in liquid fuel tank 2, the method of which is to be described later. The liquid fuel in liquid fuel tank 2 is supplied to fuel agitating section 6 by a pipe through flow control valve 4 and flow meter 5.

The water in water tank 3 is supplied to fuel agitating section 6 by a pipe through flow control valve 7 and flow meter 8. Water is passed through coil 9 just prior to entering fuel agitating section 6. Direct electric current 10 is connected to coil 9. Coil 9 forms a magnetic field.

Water severs the line of the magnetic force in this magnetic field. From the water penetrating the magnetic field, an extra current is created inside the water and the water is ionized. Furthermore, ferrite, etc., which are strong magnetic substances and have low resistance to magnetic force, are desirable for the pipe around which coil 9 is wound.

For this embodiment example, direct current electric source 10 voltage, 100 V, was used. As for the liquid fuel from second liquid fuel tank 2 and the water from water tank 3 supplied to fuel agitating section 6, they are agitatedly mixed, using a method to be described later for supplying fuel agitating section 6. Emulsion is formed by the agitatedly mixed fuel and water liquid. After being drawn from fuel agitating section 6 by pump 12 through cock 11, it is pressurized and supplied to burner 15.

Pressure gauge 13 is a meter for measuring and monitoring the ejecting pressure of pump 12 to maintain uniformity. Flow meter 14 is for measuring the established amount of mixed liquid fuel from pump 12 to burner 15. Burner 15 ejects pressurized fuel from the orifice at a high speed and fuel spray valves 18 and 19 and the blower reduce the liquid fuel into fine particles.

Since the structure of burner 15 is commonly known, it will not be described in detail here. In this embodiment, fuel spray valve 18 for preheating and fuel spray 19 for burning, were prepared. Fuel spray 18 for preheating and the blower are used only for preheating combustion chamber 16. Emulsion reduced to fine particles from spray valve 19 is burned inside combustion chamber 16 and heats combustion room 17.

Fuel Agitating Section 6

Figure 2:
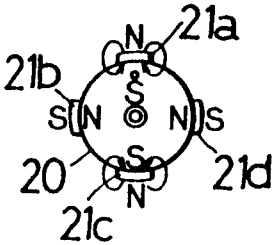
FIG. 2(*a*) is an exterior view drawing showing details of the fuel agitating section.
Figure 2:
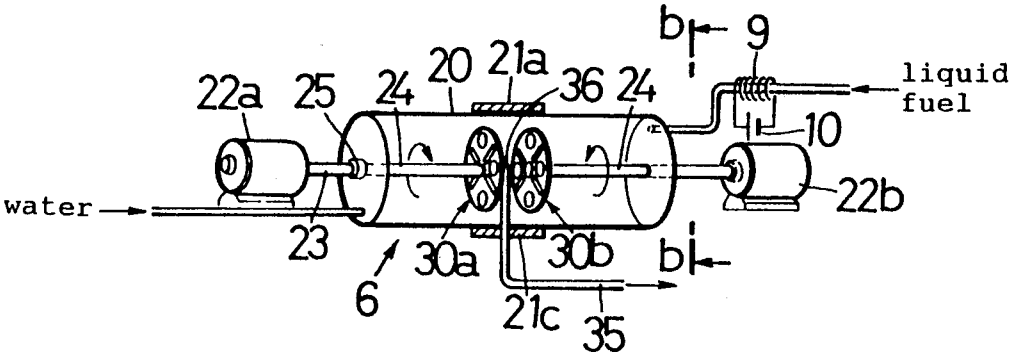

FIG. 2(*a*) is an exterior view drawing showing the structure of fuel agitating section 6 and FIG. 2(*b*) shows a sectional view taken along line b—b of FIG. 2(*a*). Agitator chamber 20 is cylindrical and is made of the nonmagnetic substance, stainless steel. In said preferred embodiment, it is approximately 200 mm in diameter.

Four permanent magnets 21*a*,21*b*,21*c* and 21*d* are fixed at equiangular intervals in the periphery of agitator chamber 20. The magnetizing direction of permanent magnet 21*a* is in the direction of the thickness of permanent magnet 21*a* as shown in the drawing. The S pole is magnetized on the side of agitator chamber 20 and the N pole on the opposite side.

Permanent magnet 21*b* is placed at a 90 degree angle to magnet 21*a* in the periphery; furthermore, the magnetic poles are placed at opposite directions. Likewise, permanent magnet 21*c*, counter to permanent magnet 21*a*, has the same pole direction as that of permanent magnet 21*a*. Permanent magnet 21*d*, counter to permanent magnet 21*b*, has the same pole direction as that of permanent magnets 21*b*. In this embodiment, permanent magnets 21*a*–21*d* with a magnetic permeability of approximately 9,000 gauss are used.

On one hand, motor 22 is placed on one end of the exterior of agitator chamber 20. Agitator shaft 24 is connected by a coupler (not shown in the drawing) to output power shaft 23 of motor 22*a*. One end of agitator shaft 24 is maintained to freely rotate through bearing 25 at the end of agitator chamber 20. For bearing 25, a common seal (not shown in the drawing) is provided to prevent leakage of liquid fuel from agitator chamber 20. Agitator disk 30*a* is arranged at the end of agitator shaft 24.

Agitating Blade 30*a*

Figure 3:
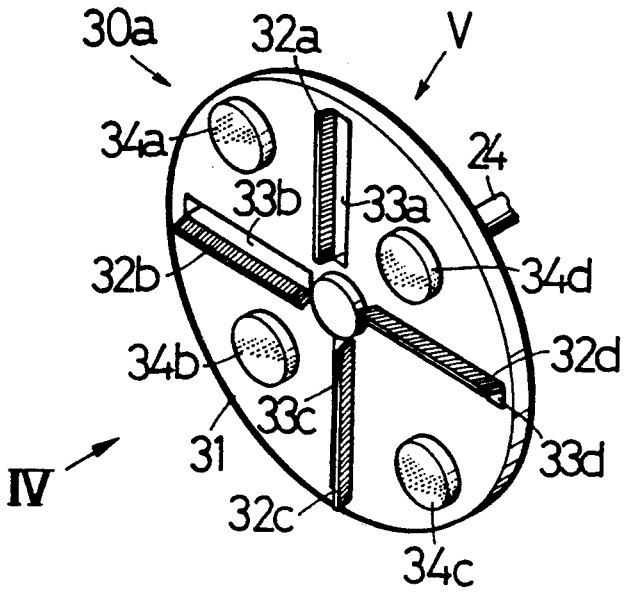
FIG. 3 is an isometric view showing agitating blades exterior.
Figure 4:
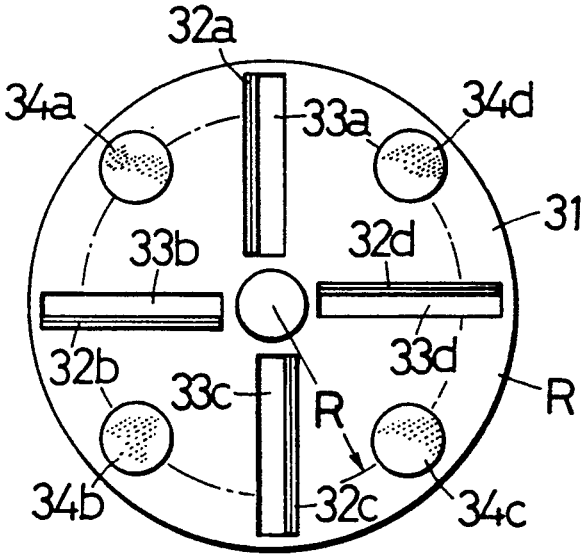
FIG. 4 is a front view taken in the direction of the the arrows IV of FIG. 3.
Figure 5:
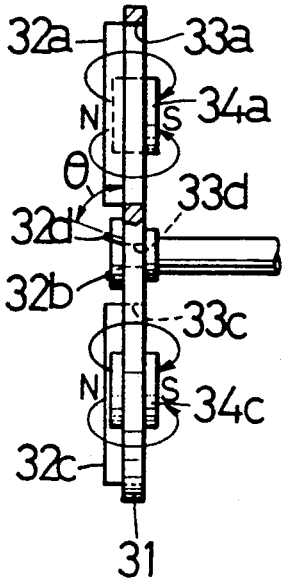
FIG. 5 is a side view taken in the direction of the arrows V of FIG. 3V.

FIG. 3 is an isometric view of the agitating blade inside agitating section 6; FIG. 4 is a front view taken in the direction of arrows IV of FIG. 3; and FIG. 5 is a side view taken in the direction of FIG. 3. Concerning agitator disk 30*a*, as shown in FIG. 3, the whole body is disk-shaped main disk body 31 and on the front face, four blades, 32*a*,32*b*,32*c* and 32*d*, are arranged at equiangular positions in straight lines.

Each of the blades 32*a*,32*b*,32*c* and 32*d* is an oblong-shaped, flat sheet, one side of which is fixed, by a mechanical connecting method such as welding, bolts, etc., to the main body disk 31. Blades 32*a*,32*b*,32*c* and 32*d* are al at angle $\theta$ to the front end of main body disk 31 (ref. FIG. 5). Parallel to blades 32*a*,32*b*,32*c* and 32*d*, penetrating holes have been molded in the main body disk 31.

Angle $\theta$ is a smaller, more acute angle than 90 degrees. An angle to thrust fuel forward toward the direction of the agitator disk 30*a* axial line is desirable. Permanent magnets 34*a*,34*b*,34*c* and 34*d* are arranged at an even radius from the center on the surface. Moreover, cylindrical permanent magnets 34*a*,34*b*,34*c* and 34*d* are inlaid and fixed inside the main disk body 31.

Permanent magnet 34*a* is magnetizing in the direction of the thickness of the magnet as shown in FIG. 5. Permanent magnet 34*b* is fixed in the main disk body 31 in the magnetzing direction opposite that of permanent magnet 34*a*. Permanent magnet 34*c* in the same direction as permanent magnet 34*a* and permanent magnet 34*d* in the same direction as permanent magnet 34*b* are respectively inlaid. Furthermore, for the experimental equipment in this embodiment, a main disk body 31 approximately 600 mm in diameter and magnets 34*a*–34*d* of 3,000–4,000 gauss in permeability were used. Main disk body 31, disks 32*a*, 32*b*, 32*c* and 32*d* were made of the nonmagnetic material, stainless steel.

Furthermore, although a corrosion-resistant quality of material is desirous, even copper sheets, etc. with magnetic materials and high resistance to corrosion will be no problem functionally. Agitator disk 30*b*, utterly the same as agitator disk 30*a*, is arranged symmetrically opposite to agitator chamber 20.

Namely, they are arranged on the agitator disk shaft 24 line. Since the make up of agitator disk 30*b* is the same as that of agitator disk 30*a*, this description will be omitted. Midway between the same agitator disks 30*a* and 30*b*, and in the center, entrance 36 to suction pipe 35 is disposed.

Combustion Chamber 16

Figure 6:
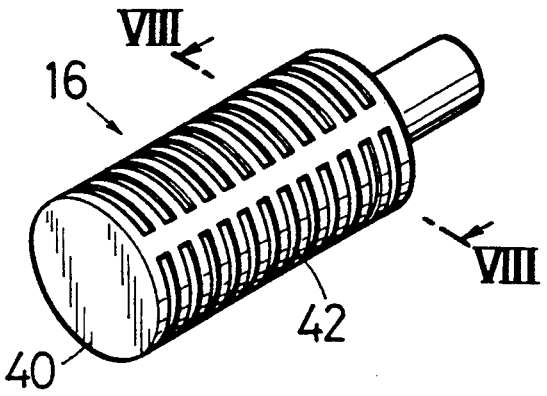
FIG. 6 is an isometric view showing a combustion chamber.
Figure 7:
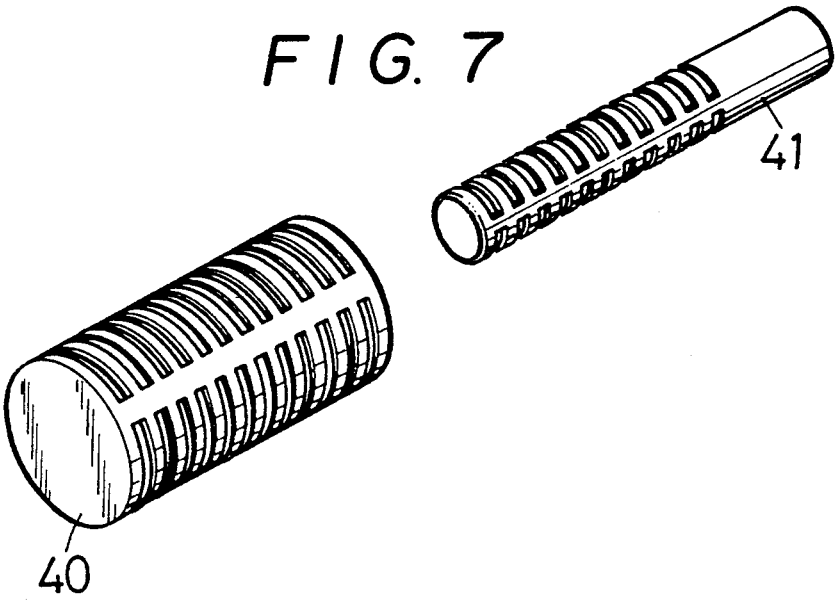
FIG. 7 is a drawing of a dismantled combustion chamber.
Figure 8:
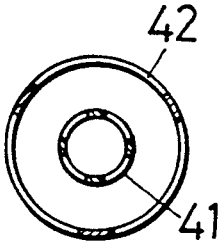
FIG. 8 is a sectional view taken along line VIII—VIII of FIG. 6.

Liquid fuel, water and emulsion from suction pipe 35 are drawn by pump 12; moreover, they are pressurized and supplied to fuel spray valve 19 of burner 15. Burner 15 makes the emulsion spray like and blows it into combustion chamber 16. FIG. 6 is a isometric view of combustion chamber 16. FIG. 7 is a dismantled combustion drawing of combustion chamber 16. FIG. 8 is a sectional view taken along line VIII—VIII of FIG. 6. Combustion chamber 16 is constructed of double tubes, outside combustion chamber 40 and inside combustion chamber 41.

Outside chamber 40 and inside chamber 41 are tube-shaped and a number of slits 42 are opened along the periphery of combustion chamber 16. Because the outside diameter of outside combustion chamber 40 is larger than the outside diameter of inside combustion chamber 41, vacant space 42 is formed. The burning of the emulsion is performed in combustion room 17, which consists of vacant space 42 and the outer part of outside combustion chamber 40

Operation

An emulsion producing apparatus and emulsion combustion system are as above and their functions are as follows:

First of all, liquid fuel is supplied from liquid fuel tank 1 through cock 18 to a pump (not shown in the drawing) inside burner 15. In this example, kerosene sold on the ordinary market was used as fuel. The pump inside burner 15 pressurizes the liquid fuel and sends it to fuel spray valve 18. Fuel spray valve 18 makes the pressurized liquid fuel into a spray-like form and sends it to combustion chamber 16.

The spray-like liquid fuel inside combustion chamber 16 is ignited for burning with an ignition device (not shown in the drawing). The liquid fuel starts burning with the air sent by a blowing mechanism (used only for preheating) and combustion chamber 16 is sufficiently heated by said combustion heat.

When combustion chamber 16 is heated with this prepared heat, cock 18*a* is shut off and the supply of liquid fuel from liquid fuel tank stops. Next, before shutting off cock 18*a*, motors 22*a* and 22*b* are started to rotate agitating blades 30*a* and 30*b* mutually in opposite directions.

In this example, they were turned at a speed of approximately 3,400 rpm. After cock 18*a* is shut off and cock 11 is opened, pump 12 draws the emulsion of emulsified and ionized liquid fuel and water from outlet 36 and sends it to burner 15 to be pressurized (approximately 8 kg/cm$^2$ in this embodiment). The emulsion is made spray-like and sent to inner combustion chamber 41 located within combustion chamber 16.

Because combustion chamber 16 is preheated in advance, burning is started by said preheating. During combustion, there is no need to input air. In fuel agitating section 6, liquid fuel supplied from liquid fuel tank 2 (kerosene in this embodiment) and water supplied from water tank 3 are agitatedly mixed by agitating blades 30*a* and 30*b*. Molecules of both liquids agitated by both agitating blades 30*a* and 30*b* furiously collide; moreover, the molecules are rotated together with permanent magnets 34*a*, 34*b*, 34*c* 34*d*. Because water as well as liquid fuel sever the lines of magnetic force, an excess current is created and ionization takes place; furthermore, emulsion is formed by mechanical mixing.

At the same time, the movement of both liquids also severs the magnetic force line of permanent magnets 21*a*,21*b*,21*c* and 21*d* arranged on the periphery of agitator chamber 20; therefore, an excess current is created inside that section and ionization is accelerated even more. That the mixed liquid is ionized means it has ionizing energy; therefore, it can be said it is in an easier combustion condition for burning.

Moreover, molecules of water and oil are colloidal particles or are dispersed as even smaller particles, becoming emulsified; therefore, it is in a perfectly easy burning condition. Accordingly, without actively forcing air into combustion chamber 16, continuous combustion can be had.

The theory of said continuous combustion is obscure in accuracy, however, by the ionization of water, liquid fuel and emulsion and molecules of water dispersing into hydrogen and oxygen, it can be assumed that the hydrogen and oxygen are functioning effectively. According to experiments by this inventor, continuous combusion could be had with even a large 42:58 liquid fuel to water mixing ratio.

For this reason, because moisture in the combustion gas is abundant, heat transfer efficiency is high. For combustion systems like boilers, etc., it is optimum. Furthermore, it burns at a comparatively low temperture; therefore, there is little NOx resulting.

Test Data

Kerosene and emulsion produced by this invented system were actually burned and the amounts of nitrogen dioxide (NOx) and sulfur dioxide (SOx) were measured.

This test data is shown as follows:

Chamber core: Outer diameter 270 mmϕ; length 500 mm cylindrical shape or 300 mmϕ globe-shape; material chrome molybdenum copper (JIS-SCM 415) was used.

Combustion chamber: (furnace inside) height 1,000 mm; depth 950 mm; width 1,100 mm. Outside wall of furnace is heat insulated with firebricks.

| | ① kerosene cylinder temp. 1025° C. inside furnace temp. 390° C. | ② emulsion cylinder temp. 850° C. inside furnace temp. 610° C. |
|---|---|---|
| Nitrogen dioxide (NOx) | *10 ppm | **5 ppm |
| Sulfur dioxide (SOx) | *less than 20 ppm | **less than 20 ppm |

For the combustion test, a duct that tightly sealed the air opening was installed and the speed of the air flowing through that pipe was measured. The results were *2.2 $m^3$/min when burning kerosene and **0.073 $m^3$/min when burning the emulsion.

Accordingly, when the amount of air for burning kerosene is set at 100%,the amount of air used for burning the emulsion becomes 3.3%. From the figures shown in the above table, the amounts of nitrogen dioxide (NOx) and sulfur dioxide (SOx) in the gas emission become substantially lower (approximately 30 times) when emulsion is used compared to when only kerosene is used.

Second Embodiment of Agitation Equipment

Figure 9:
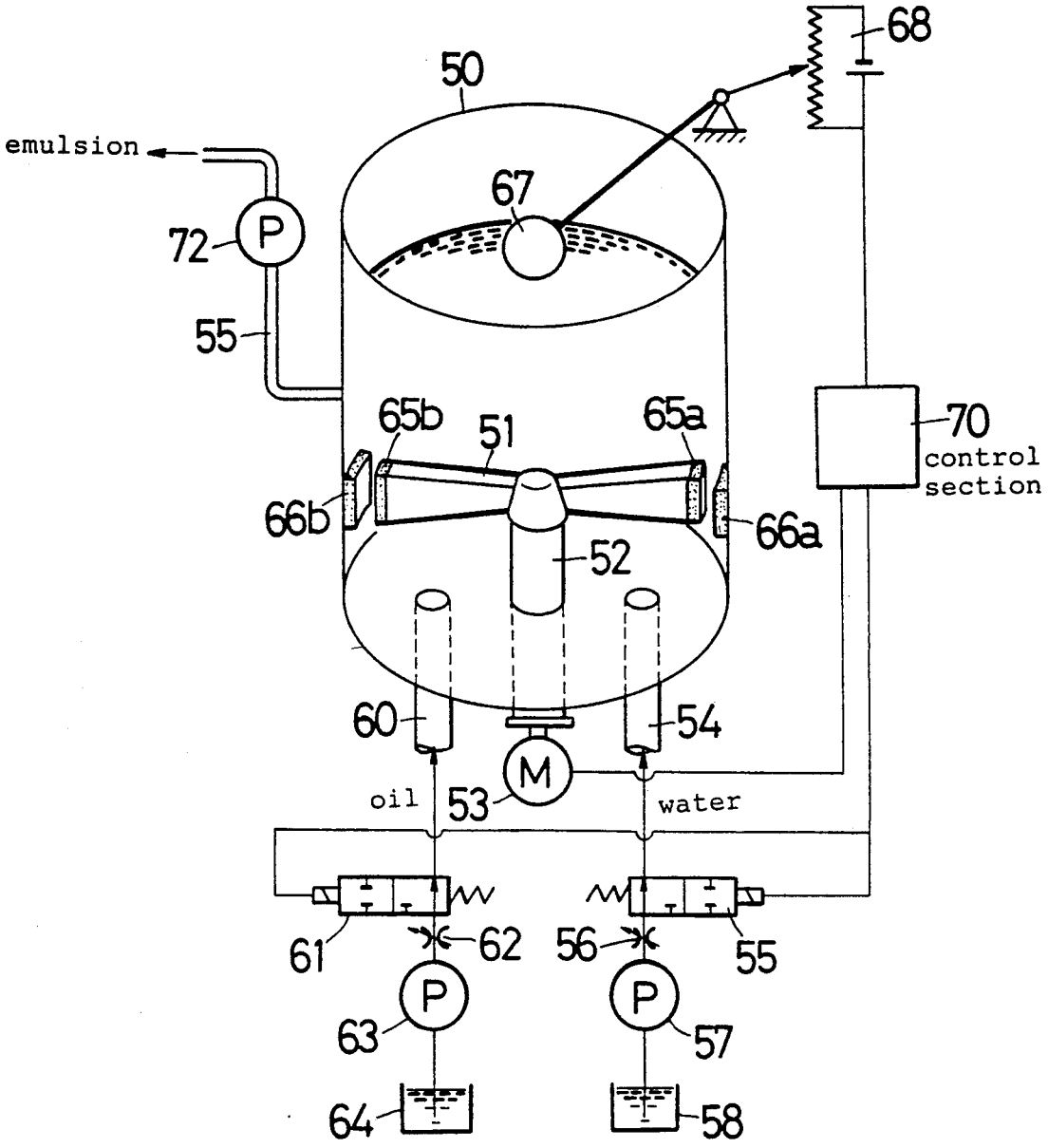
FIG. 9 is a conceptional drawing of another agitating equipment.

FIG. 9 is a conceptional drawing of agitation equipment in a second embodiment of the present invention.

In said first embodiment, a fixed flow of emulsion was continuously supplied. In the second embodiment, only the required amount of emulsion is automatically supplied. Agitator chamber 50 is cylindrical in shape. Freely rotating agitating blades 51 have been arranged.

The bottom plate of agitator chamber 50 maintains the free rotation of both blades 51 and and center axle 52 by a bearing with an oil seal (not shown in the drawing). The other end of center axle 52 is coupled with the output shaft of motor 53. Pipe 54 is connected to agitator chamber 50. Electromagnetic switchover valve 55, flow control valve 56 and pump 57 are successively connected to pipe 54.

Pump 57 presurizes the water in water tank 58 and supplies agitator chamber 50. Similarly, electromagnetic switchover valve 61, flow control valve 62 and pump 63 are connected to pipe 60 which is connected to agitator chamber 50. Pump 63 draws up liquid fuel from liquid fuel tank 64 and supplies it to agitator chamber 50. Permanent magnets 66*a* and 66*d* are installed on the inside wall of agitator chamber 50.

Permanent magnets 66*a* and 66*b* are installed on the inside wall of agitator chamber 50. Permanent magnets 65*a* and 65*b* in blades 51 and 51 counter permanent magnets 66*a* and 66*b* on the inside wall of agitator chamber 50 and mutually cut the line of magnetic induction in the same said way as in the first embodiment.

Float 67 is arranged inside agitator chamber 50, and potentionmeter 68 interlocks with the movement of float 67 and goes into motion. The output of potentiometer 68, i.e., the current amount of emulsion in agitator chamber 50, is input into control section 70. When the emulsion in control section 70 becomes less than the fixed amount, electromagnetic switchover valves 61 and 55 change over at the same time and motor 53 turns on.

The fuel from liquid fuel tank 64 is drawn up by pump 63 and passes through flow control valve 62 and electromagnetic switchover valve 61 to be supplied to agitator chamber 50. Likewise, the water in water tank 58 is drawn up by pump 57 and passes through flow control valve 56 and electromagnetic switchover valve 55 to be supplied to agitator chamber 50. As with the first embodiment, emulsion is produced inside agitator chamber 50. Only the required amount of produced emulsion is supplied to the essential apparatus by pump 72.

When the emulsion is less than the fixed amount, float 67 lowers and that signal is output by potentiometer 68. Control section 70 receives this signal and opens electromagnetic switchover valves 55 and 66 to supply water and liquid fuel. Motor 53 is driven and emulsion is produced in the same way as previously mentioned. Moreover, although in FIG. 9 an embodiment where the two permanent magnets 66*a* and 66*b* were arranged on the peripheral wall of agitator chamber 50, even four will be all right.

Agitator chamber 50 in the second embodiment is cylindrical and made of a nonmagnetic stainless steel plate approximately 200 mmϕ in diameter. Motor 53 is rotated at approximately 150 rpm. Flow control valves 62 and 56 were adjusted to time supply water and oil in the ratio of 55% and 45%, respectively.

Second Embodiment of Combustion Chamber

Figure 10:
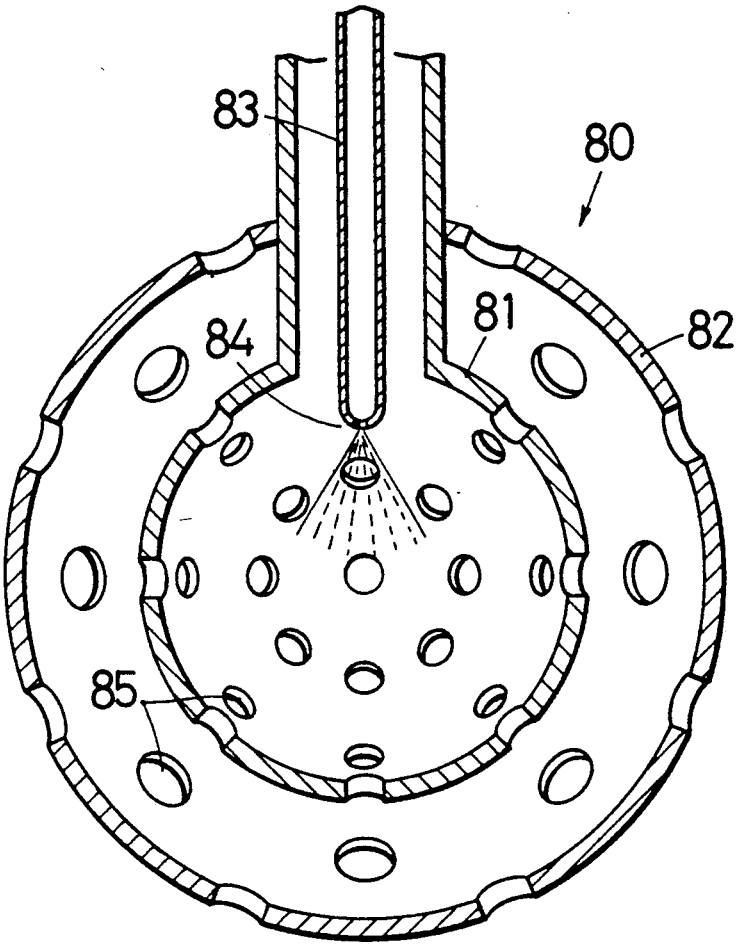
FIG. 10 is a sectional view of a globe-shaped double wall combustion chamber in another embodiment.

FIG. 10 is a sectional view of globe-shaped agitator chamber 80 as well as a double wall-type chamber. Inside wall 81 and outside wall 82 (approximately 300 mmϕ) are fixed. In each of the walls, numerous fire emission openings 85 are arranged. Emulsion fuel is supplied by nozzle 84, with a spraying angle of 60 degrees, from the periphery of inside wall 83. Moreover, at this time, it is desirous that the spraying position of nozzle 84 is in the center of inside wall 81 and that the spraying angle is large.

Other Embodiments

Permanent magnets 21*a*, 21*b*, 21*c* and 21*d* arranged in agitator chamber 20 of said embodiments could be omitted. Although efficiency would be slightly lowered, production would be sufficient. The same can be said of permanent magnets 66*a* and 66*b* arranged in agitator chamber 50.

In first embodiment coil 9, direct current 10 was disposed in the pipe from water tank 3 to the outlet and an electromagnet was formed. However, not only an electromagnet, but also a permanent magnet would be fine. Again, these arrangements are not absolutely necessary.

The same can also be said of permanent magnets 21*a*, 21*b*, 21*c*, 21*d*, 66*a* and 66*b*. These permanent magnets 21*a*, 21*b*, 21*c*,21*d*, 66*a* and 66*b* used permanent magnets, however, electromagnts could also be used. Again, these permanent magnets 21*a*, 21*b*, 21*c*, 21*d*, 66*a* and 66*d* can be limited to four in number.

The four permanent magnets 34*a*, 34*b*, 34*c* and 34*d* in main disk body 31 of the first embodiment are indispensable, however, they do not necessarily have to be limited to four. Under different circumferences, many could be arranged. Again, the shape of blades 32*a*, 32*b*, 32*c* and 32*d* do not have to be limited to that of the embodiment. Other generally known shapes would be fine. The same can be said of the blade 51 in the second embodiment and the arrangement of the permanent magnets.

I claim:

1. An emulsion producing apparatus comprising:

a liquid fuel tank (64) for storing liquid fuel;

a water tank (58) for storing water;

an agitating chamber (50) to which said liquid fuel and said water from said liquid fuel tank (64) and said water tank (58) are supplied;

an agitating blade (51) arranged inside said agitating chamber (50) for agitatedly mixing said liquid fuel and water;

a plurality of movable permanent magnets (65*a*, 65*b*) arranged on said agitating blade (51); and an agitating blade driving motor (53) for driving said agitating blade (51) to produce pulsed eddy currents resulting in an ionized emulsion.

2. An emulsion producing apparatus according to claim 1, further comprising:

multiple fixed magnets (66*a*, 66*b*) arranged in said agitator chamber (50) to counter said movable magnets (65*a*, 65*b*).

3. An emulsion producing apparatus comprising:

a liquid fuel tank (2) for storing liquid fuel;

a water tank (3) for storing water;

an fuel agitating section (6) to which said liquid fuel and said water from said liquid fuel tank (2) and said water tank (3) are supplied;

an first agitating blade (30*a*) arranged inside said agitating section (6) for agitatedly mixing said liquid fuel and said water;

a plurality of first movable permanent magnets (34*a*, 34*b*, 34*c*, 34*d*) arranged in said first agitating blade (30*a*);

a first agitating blade driving motor (22*a*) for driving said first agitating blade (30*a*);

a second agitating blade (30*b*) arranged inside said fuel agitating section (6) to counter said first agitating blade (30*a*);

a plurality of second movable magnets arranged in said second agitating blade (30*b*); and a second agitating blade driving motor (22*b*) for driving said agitating blade (30*b*) to produce pulsed eddy currents resulting in an ionized emulsion.

4. An emulsion producing apparatus according to claim 3, further comprising:

fixed magnets (21*a*,21*b*,21*c*,21*d*) are arranged on the periphery of said fuel agitating section (6).

5. A combustion system according to any one of claim 1,2,3 and 4, further comprising:

fuel pumps (12,72) for pressurizing emulsion produced from said liquid fuel and said water drawn out from said agitator chamber (6,5);

a burner (15) for spraying said emulsion from said fuel pumps (12,72) into fine particles and spray.

6. A combustion system according to claim 5, further comprising:

a combustion chamber (16,80) which is formed with space provided inside and numerous slits to burn said emulsion from said burner (15).

7. A combustion system according to claim 6, wherein said combustion chamber is globe-shaped and includes double inside and outside walls.

* * * * *